US005650045A

United States Patent [19]

Salminen

[11] Patent Number: 5,650,045

[45] Date of Patent: Jul. 22, 1997

[54] APPARATUS AND METHOD FOR WOOD PULP DIGESTER

[76] Inventor: Reijo K. Salminen, 373 Cove Rd., Bellingham, Wash. 98225

[21] Appl. No.: 355,843

[22] Filed: Dec. 14, 1994

[51] Int. Cl.[6] ..... D21C 3/26; D21C 7/00

[52] U.S. Cl. ..... 162/19; 162/17; 162/242; 162/236

[58] Field of Search ..... 162/19, 17, 1, 162/24, 25, 26, 29, 34, 41, 43, 233, 235, 236, 241, 250, 251, 77

[56] References Cited

U.S. PATENT DOCUMENTS

| | | | |
|---|---|---|---|
| 3,380,883 | 4/1968 | Richter et al. | 162/19 |
| 3,434,920 | 3/1969 | Green | 162/37 |
| 3,652,384 | 3/1972 | Sloman | 162/19 |
| 4,071,399 | 1/1978 | Prough | 162/16 |
| 4,265,675 | 5/1981 | Tsao et al. | 127/37 |
| 4,496,426 | 1/1985 | Baumeister et al. | 162/77 |
| 5,080,755 | 1/1992 | Backlund | 162/19 |
| 5,413,677 | 5/1995 | Collins | 162/42 |
| 5,470,433 | 11/1995 | Brodersen et al. | 162/77 |

*Primary Examiner*—Donald E. Czaja
*Assistant Examiner*—Calvin Padgett
*Attorney, Agent, or Firm*—Robert B. Hughes; Hughes, Multer & Schacht

[57] ABSTRACT

A continuous pulp digesting apparatus where wood chips and a cooking liquor are directed into a first cooking zone, and a portion of the cooking liquor is extracted at an intermediate region downstream, of said first cooking zone. Fresh liquor is introduced into said intermediate region to adjust pH level to inhibit scaling and/or clogging of strainers in the digester, and further digesting is accomplished in a second cooking zone downstream of an intermediate region. Liquor is extracted through strainers at a lower location of said second cooking zone.

10 Claims, 2 Drawing Sheets

APPARATUS AND METHOD FOR WOOD PULP DIGESTER

The present invention relates to wood pulp processing and specifically to an apparatus and method for the digester of a pulp mill. More specifically, the present invention relates to such a method and apparatus which permits greater flexibility in the type of wood chips processed and the composition of the liquor used in the digester by providing a system to alleviate the scaling and clogging that would otherwise result on the strainers of the digester when certain compositions of the liquor are used with certain types of wood chips.

BACKGROUND OF THE INVENTION

In the pulp processing industry, wood chips are introduced into a digester where these are treated under high pressure and temperature by a liquor that is introduced into the digester to break down the lignin and hemicellulois content of the wood fibers, leaving only the cellulose. During the digesting process, the liquor is drawn out of the digester at various locations and recirculated to the digester. So that the wood chips remain in the digester, it is necessary that the liquor that is being removed passes through a strainer which has slot like openings that prevent the passing of wood chips but permit the passage of the liquor therethrough.

If the strainers in the digester become clogged, then it is commonly necessary to shut down the digester and remove the scaling from the strainers. Such a shutdown can be extremely costly, and make it economically unfeasible to operate the pulp mill in that manner. Quite commonly this problem is alleviated by formulating the composition of the liquor so that certain components of the liquor will prevent the formation of the scaling on the strainers.

This formulation will depend to some extent on the species of the wood from which the chips are made. For example, with soft wood, the scaling would be more of a problem. An example of this is in a digester which uses alcohol (either ethyl or methyl alcohol) as one of the major components of the liquor. If soft wood is being treated in the digester, there is more of a tendency for scaling to form. However, the addition of sodium hydroxide to the liquor composition substantially alleviates the scaling problem.

The further treatment of the black liquor resulting from the digester process is also an important part of the operation of a pulp mill. In order to operate a pulp mill economically, it is generally necessary to process or utilize the black liquor in some manner to extract value therefrom. This can be done in various ways. Generally, the black liquor goes to an evaporator where a substantial portion of the water content is removed. Then the residue from the black liquor can be burned to generate heat energy which is utilized in other parts of the pulp mill and to recover the non-organic chemicals in the liquor for recirculation in the pulping process. Alternatively, the residue remaining in the black liquor after the evaporation can be utilized in other applications, such as producing adhesive for particle board or animal food pelletizing, etc.

SUMMARY OF THE INVENTION

In view of the foregoing, it is the principle object of the present invention to provide method and apparatus for a digester in a pulp processing system which is able to alleviate the problem of clogging and the formation of scaling on the strainers of the digesters to allow more flexibility in the formulation of the composition of the digesting liquor. One specific advantage of the present invention can in some instances result in enabling the black liquor to be utilized in a manner which could be more profitable.

A specific application of the present invention is to be utilized in a digester using ethyl and/or methyl alcohol as the main active ingredient of the digesting liquor, while processing wood chips (such as wood chips from soft woods) which are prone to cause clogging of the strainers.

Briefly, this is accomplished by cooking liquor under heat and pressure during an initial cooking phase, and then extracting at least a portion of the liquor and introducing fresh liquor to adjust pH level of the cooking liquor, after which a second phase of cooking of the wood chip material is accomplished.

The apparatus of the present invention comprises a containing structure defining a processing chamber, and having an inlet means to receive wood chip material and a cooking liquor into the chamber, and an outlet means to discharge digested wood material. The containing structure defines the cooking zone within which the liquor reacts with the wood chip material during a digesting cycle.

There is strainer means located in the containing structure to permit an outflow of liquor from the chamber, while retaining the wood chip material in the chamber. There is also means to extract a portion of the digesting liquor from the processing chamber through at least a portion of the strainer means at an intermediate part of the digesting cycle.

There is also means to introduce at least a portion of relatively fresh liquid into the chamber to replace at least part of the digesting liquor removed so as to adjust pH level of the digesting liquor in the chamber to inhibit scaling and/or clogging of the strainer means.

In the preferred form, the pulp digester apparatus is a continuous digester and defines a cooking zone having an inflow region, an outflow region, and an intermediate region between the inflow region and the outflow region, with the portion of the digesting liquor being extracted from said intermediate region.

There is also in the preferred form means to recirculate at least a portion of the digesting liquor back to the digesting zone and selectively direct a portion of the digesting liquor extracted to another location for further processing. Further, in the preferred form, there is a second means to extract a second portion of digesting liquor form the digesting chamber at a location downstream of the intermediate processing region, and this is accomplished through another portion of said strainer means.

In the method of the present invention, a digesting apparatus is provided as described above. The wood chip material and the cooking liquor are directed into the chamber and the initial cooking of the wood chip material under heat and pressure is accomplished during an initial cooking phase. Then at least a portion of the digesting liquor is extracted from the processing chamber subsequent to the initial cooking phase through at least a portion of the strainer means, while retaining the wood chip material in the chamber.

Then there is introduced into the chamber a portion of relatively fresh liquor to replace at least part of the digesting liquor removed so as to adjust the pH level of the digesting liquor to a level to inhibit scaling and/or clogging of the strainer means.

Other features of the present invention will become from the following detailed description.

DESCRIPTION OF THE PREFERRED EMBODIMENT

Figure 1:
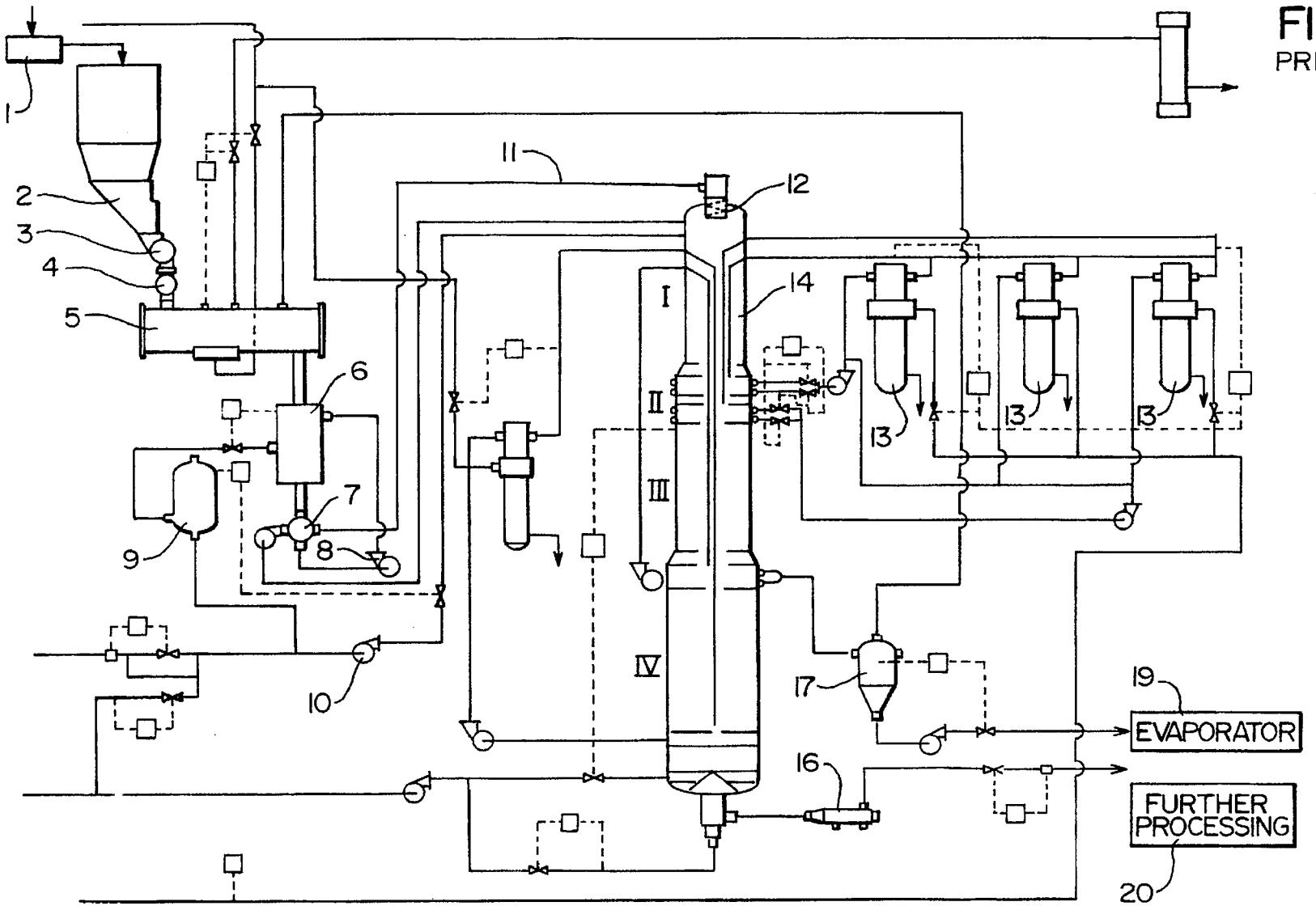
FIG. 1 PRIOR ART
FIG. 1 is a somewhat schematic drawing illustrating a digesting portion of a prior art pulp processing system in which the present invention can be effectively utilized.

It is believed that a clearer understanding of the present invention will be obtained by first reviewing the digesting portion of a typical pulp mill for which the present invention is particularly adapted. With reference to FIG. 1, the wood chips are first subjected to magnetic separation of tramp iron and screening at location 1, and then directed into a surge bin of a hopper indicated at 2. From the hopper, the chips flow into a chip meter 3 which controls the rate of flow of the chips which then pass into a low pressure feeder 4.

The feeder 4 directs the chips into a steaming vessel 5 that is kept at between 15 to 20 PSI where the chips are pre-steamed. The chips are then directed from the steaming vessel 5 into the chip chute 6, from which the chips move to a high pressure feeder 7. The chips are flushed into the feeder by means of a chip chute circulating pump 8. As seen in FIG. 1, the flow from the pump 8 into the chip chute 6 and to the feeder 7 is in a counterclockwise direction. Liquor level of the chip chute 6 is controlled by the level tank 9. The wood chips mixed with a certain amount of liquor are then moved from the feeder 7 through a line 11 into a top strainer 12 to the top of the digester 14. A high pressure pump 10 introduces the cooking liquor to the digester, as well as the excess liquor from the chip chute level tank 9. The volume of the cooking liquor can be controlled by a magnetic flow meter.

In general, the digester pressure is controlled so as to be at about 200 PSI. The chips and the cooking liquor gradually move downwardly in the digester, first passing into an upper impregnation zone I and then to the heating zone II.

The temperature is raised in two steps by two cooking circulating systems, which comprise extraction strainers, pumps and central circulating chambers. Three heaters 13 are shown. After heating, the chips and liquor pass downwardly through the cooking zone III of the digester. As the chips then pass into the lower washing zone IV of the digester, extracted wash liquor is circulated through the chips to provide a quench of the cooking reaction. The chips continue to pass downwardly in the washing zone IV, then to be discharged. The entire sequence is arranged so that the duration of the digesting process is about one and one half to four hours.

Wash liquor from a subsequent filter tank or fresh hot water is pumped into the bottom of the digester and flows upwardly countercurrently to the chip flow. Elevated temperatures of 125° to 135° C. are controlled in the diffusion zone by an auxiliary wash liquor circulation and heater system.

At various locations in the digester, the liquor is recirculated to an upper location. A portion of the liquor that is extracted between zone III and zone IV is directed to a flash tank 17, and thence to flash heat evaporators. The pulp that is extracted from the bottom of the digester is directed to a blow unit 16 which has a pressure reducing function, and then further directed to a brown stock washer or to some other location for further processing. Eventually the black liquor developed during the digesting process is directed to an evaporator 19, and then for further processing as indicated schematically at 20.

Since the section of the wood pulp processing system shown in FIG. 1 (and also the entire pulp processing operation which would be compatible with the digesting section shown in FIG. 1) are well known in the prior art, these will not be described in detail any further. It is to be understood that to the extent that the novel components of the present invention cooperate advantageously with the other components or sections with the entire pulp processing operation, such components are deemed to be part of the disclosure of the present invention. For example, the present invention can result in an advantageous further use of the components derived from the black liquor, and as will be disclosed more fully later herein, this may permit the black liquor to be used in a manner that the lignin and other components derived from the wood fiber can advantageously be used for example, as a glue, binder, or constituent of other products such as panels, animal feed, etc.

In the preferred embodiment of the present invention, the active ingredient in the white liquor that is directed into the digester 102 is alcohol (desirably ethyl alcohol, methyl alcohol, or a combination of the two). The use of alcohol as the active ingredient has a number of desirable features, a significant one of which is that it alleviates substantial pollution problems that are inherent in other pulp digesting processes. Also the alcohol itself can more readily be recovered in a gaseous state and condensed, to be then redirected back through the system.

However, for some types of wood products (particularly soft wood) if alcohol is used alone as the digesting medium, then there is a tendency for the black liquor to form scaling on the outlet screens or strainers. If this problem is not alleviated in some manner, after possibly a couple weeks or so of operation, the screens become clogged sufficiently so that the digester has to be shut down, emptied, and the screens cleaned. Obviously, the cost of this is very substantial, and thus in many instances makes the use of alcohol as the main digesting medium impractical.

A method of alleviating this is to add some other ingredient to the processing liquor to counteract this scaling. In the prior art, this can be done by adding sodium hydroxide in a sufficient amount to prevent the scaling. The sodium hydroxide then remains as part of the solids in the black liquor. The sodium hydroxide is sufficiently expensive so that to operate the mill in an economical fashion, sodium hydroxide is often recovered from the black liquor and reused in the system.

Then there is the problem of separating the sodium hydroxide from the other components of the black liquor (mainly the lignin). One manner of accomplishing this is simply to burn the lignin and use the heat in the operation of the pulp mill. Another alternative is simply to use the lignin for some commercial purpose, but the presence of the sodium hydroxide limits the uses for such lignin.

The present invention is intended to alleviate this problem.

Figure 2:
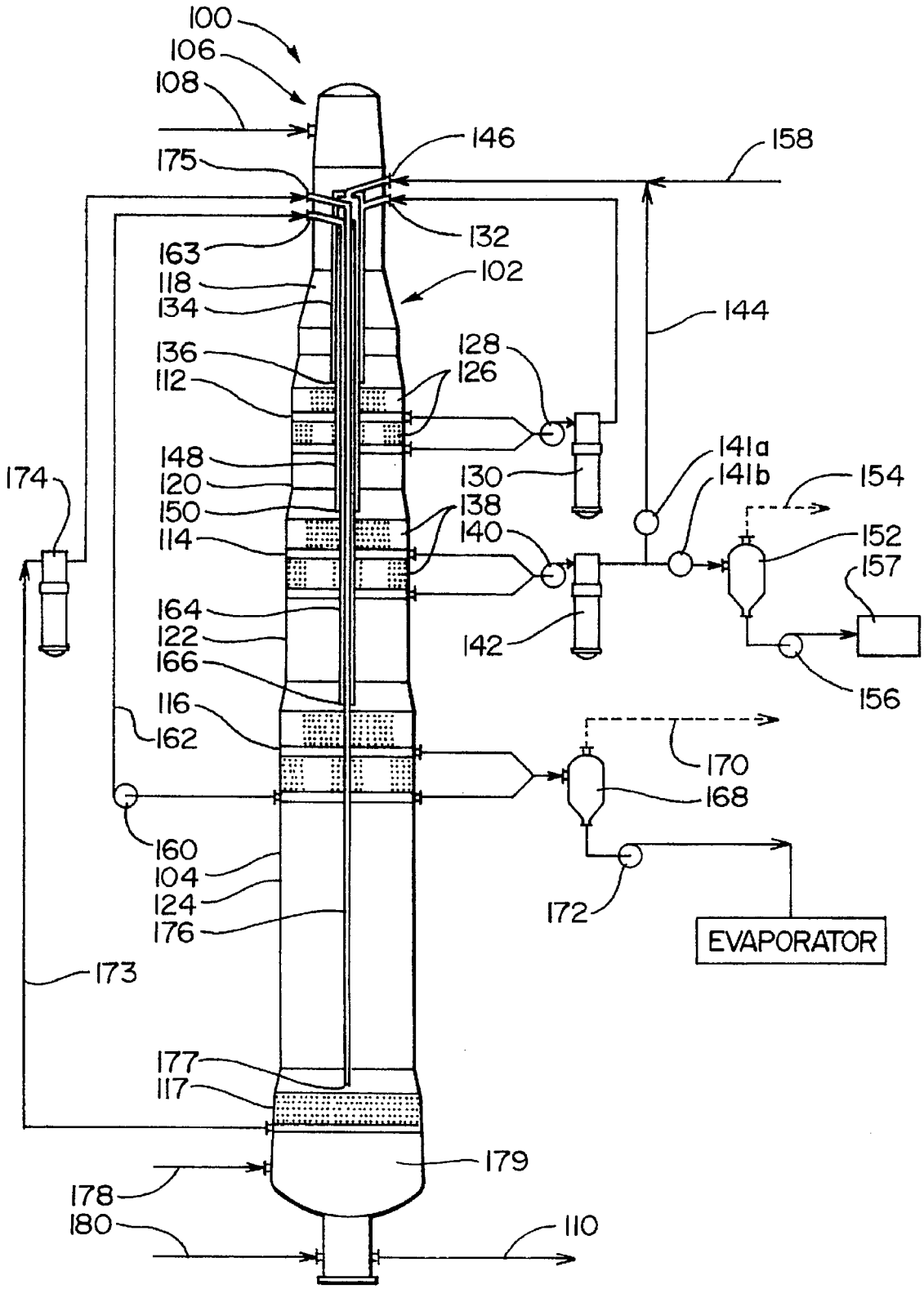
FIG. 2 is a semi-schematic view showing a pulp digester, such as that shown in FIG. 1, incorporating the teaching of the present invention in a pulp processing system similar to that shown in FIG. 1.

FIG. 2 shows the digester system 100 of the present invention, comprising a digester 102 which is of the general type as the prior art digester shown at 14 in FIG. 1. This digester 102 comprises a vertically aligned containing structure 104, also called a tower, having an upper end 106 into which wood pulp is directed through an intake opening schematically shown at 108, and into which processing liquor is introduced.

The digester 100 has four extraction locations, namely an upper extraction location 112, an intermediate extraction 114, a lower extraction location 116, and a lowermost extraction location 117. Also, the digester 100 has four processing zones, namely an upper impregnating zone 118, located above the first upper extraction zone 112, an initial delignification zone 120 positioned between the upper extraction location 112 and the intermediate extraction location 114, a final cooking zone 122 located between the extraction locations 114 and 116, and a lowermost high heat washing zone 124 located below the third lower extraction location 116.

At the upper extraction zone 112 there are two vertically spaced sets of screens 126 through which the liquid (i.e. liquor) that has moved with the pulp downwardly through the impregnation zone 118 is drawn by a pump 128. The pump directs this liquor through a first heat exchanger 130 and thence upwardly into an inlet 132 to flow downwardly through a outermost pipe 134 positioned vertically in the center of the upper part of the digester 102. The exit end of the pipe 134 is indicated at 136, which is at the location of the first extraction location 112.

Thus, it can be recognized that the liquid extracted at 112 is moved by the pump through the heat exchanger to raise its temperature, and then back into the digester to flow into and through the pulp and thence be recirculated again through the pipe 128. The mixture of liquor and pulp that flows downwardly from the upper extraction location 112 goes through an initial cooking or delignification stage, where a substantial portion of the lignin in the pulp is acted upon by the white liquor to cause a substantial portion of the lignin and other organic products to be dissolved in the liquor.

Then when the mixture of pulp and liquor flowing downwardly from the upper extraction location 112 reaches the second extraction location 114, a portion of the black liquor is extracted through the two sets of screens 138 at the intermediate extraction location 114 by the action of a pump 140. The pump directs the extracted liquor through another heat exchanger 142, and the liquor is directed by valves 141*a* and 141*b* in either or both of two directions.

First a portion of the liquor flowing from the heat exchanger 142 is recirculated through a line 144 and into an inlet 146 to flow downwardly through another centrally located pipe 148 positioned concentrically within the outer pipe 142, with the flow from this second pipe 148 exiting at 150 in the digester. This recirculation through the heat exchanger 142 is simply to add heat and thus maintain the temperature within the digester 102 at the appropriate level.

A second portion of the liquor extracted at the intermediate location 114 is directed to a flash tank 152. A portion of the alcohol and water from the liquor is extracted at 154 and is directed to a condenser to be reused in the system. The remaining liquor, with lignin therein and also some water and alcohol is directed by a pump 156 to an evaporator, indicated schematically at 157. At the evaporator there is alcohol and lignin recovery.

At this point, it is important to note that additional white liquor is introduced into the line 158 as clean liquor, so that when it combines with the liquor recirculated in the line 144 (which liquor has already reacted with the wood chips so as to have lignin and other material dissolved therein), the resulting mixture that flows further downwardly from the extraction zone 114 has been diluted and has a lower concentration of lignin and other organic material from the wood pulp. The importance of this will be discussed further later in this text.

Then the mixture of liquor and wood pulp that flows from the intermediate extraction location 114 downwardly through the zone 122 is further delignified. A substantial portion of this liquor is extracted at the lower extraction zone 116 in two directions. First, a portion of this liquor is drawn out by the pump 160 to flow upwardly through line 162 to an intake opening 163, and thence into a central tube 164 to exit at a lower location 166.

A second portion of this liquor at the lower extraction zone 116 is directed into a flash tank 168, with the alcohol and water exiting at 170 from the flash tank to be directed to a location for recovery and recirculation back into the system. The liquor from the flash tank 168 is directed by a pump 172 to the evaporator where the lignin is recovered and remaining alcohol is evaporated and recirculated back through the system.

At the lowermost extraction location 117 the liquor is recirculated through the line 173, to a heat exchanger 174, to an inlet 175, down a central pipe 176 and out at 177.

Wash water is directed through the line 178 into the lowermost section 179 of the digester 102 to mix with the wood chips that have been processed as these digested wood chips flow downwardly to be discharged at 110. Also, dilution water is directed through the line 180 into the exit area for the pulp to be added to the pulp that is then directed to a location for further processing, presumably a brown-stock washer.

A significant features of the present invention is that the liquor in the digester is extracted at two different locations to be directed to the evaporator. In the present embodiment shown herein, the liquor is extracted at 114 between the initial delignifying zone 120 and the final cooking zone 122 further below. Then the rest of the black liquor is extracted at the third extracting location 116 below the final cooking zone.

The white liquor that is initially introduced through the inlet 108 at the very top of the digester is substantially pure white liquor, free from organic contaminates (e.g. lignin and other organic materials from the wood chips). Also, the lignin which is introduced in the line 158 to enter into the pulp liquor mixture at the second extraction zone 114 is also substantially pure white liquor. When the white liquor is first introduced into the wood chips it has a pH value of approximately 6.5. However, as the digesting process continues and the white liquor reacts with the organic material in the wood chips, this pH lowers. At a certain pH level (which is below 6.5, and somewhat higher than a pH of 3.5 to 4.0), the lignin (and possibly other organic material) tends to form into a sticky material which then forms as scaling on the inlet portion of the screens. This is alleviated in the present invention as follows.

The digesting process is controlled so that the liquor in the digester has not reached a sufficiently low pH to cause any appreciable amount of scaling when it arrives at the intermediate extraction location 114. At this intermediate extraction location 114, a portion of the liquor is removed by the pump 140. At the same time this is happening, the makeup clean white liquor is directed through the line 158 to exit at the pipe location 150 and mix with the wood chips and the liquor that were already in the digester at the extracting location 114. This fresh white liquor (having a pH value of about 6.5) raises the overall pH value of the liquor in the digester that now moves from the intermediate extraction location 114 down to the third extraction location 116. As the cooking process continues in the final cooking zone 122, the pH of the liquor again drops, but the process is controlled so that the pH value at the third extracting location 116 is still higher than that at which the scaling would occur on the outlet screens.

Various control techniques can be used to accomplish the ends of the present invention. A major control technique is that the liquor that flows from the heat exchanger 142 flows partly to the flash tank 152 and partly is recirculated back up through the inlet 146. If it is necessary to raise the pH at the extracting location 114 to a higher level, then a greater percentage of the liquor is directed to the flash tank 152, and more clean white liquor is added at 158. On the other hand, if it is not necessary to raise the pH level to that extent at the extraction location 114, a greater amount of the liquor can be recirculated through the line 144 and to the inlet 146, and the amount of fresh white liquor at 158 reduced.

As another facet of the present invention in addition to introducing fresh white liquor through the line 158 so as to be introduced at the location 150, other ingredients such as sodium hydroxide for raising the pH could be added at this location to serve some particular purpose.

It should also be noted that a significant amount of the lignin of the wood chip is located near the surface areas of the wood fibers, and the cooking that occurs in the initial delignification zone 120 causes a substantial percentage of the lignin to move out of the wood chips and be dissolved in the surrounding liquor. Thus, the recovery process that can be conducted with the liquor extracted from the flash tank 152 can provide a substantial amount of lignin.

When the chips pass further downwardly into the lower washing zone of the digester, the wash water is circulated through the chips in a manner conventional in the prior art, so this will not be described in detail herein.

It is evident that various modifications could be made in the present invention without departing from the basic teachings thereof.

What is claimed is:

1. A pulp digester apparatus which is arranged to utilize a cooking liquor consisting essentially of alcohol, selected from a group of ethyl alcohol, methyl alcohol, and combinations thereof, and to digest a wood chip material which is characterized in that said wood chip material, in being cooked by said liquor, forms scaling on strainer means of the digester when pH of the cooking liquor is at a scale forming pH level between about 3.5 and 6.5, said apparatus comprising:

a. a containing structure defining a digesting chamber and having an inlet means to receive said wood chip material and said cooking liquor into said digesting chamber, an outlet means to discharge said digested wood chip material, and at least first and second cooking zones within which the cooking liquor digests the wood chip material during a digesting cycle;

b. strainer means located in said containing structure to permit an outflow of liquor from said digesting chamber, while retaining said wood chip material in said digesting chamber;

c. means to extract a portion of cooking liquor from said processing chamber through at least a portion of said strainer means between said cooking zones at an intermediate part of said digesting cycle as said wood chip material is moving through said cooking zones;

d. means to introduce at least a portion of a relatively fresh liquor into said digesting chamber to replace at least part of the cooking liquor removed so as to adjust pH level of the digesting liquor upwardly in the digesting chamber to a pH level sufficiently high to inhibit scaling and/or clogging of said strainer means as said wood chip material continues through the digester.

2. The apparatus as recited in claim 1, wherein said pulp digester apparatus is a continuous digester and defines a cooking zone having an inflow region, an outflow region, and an intermediate region between the inflow region and the outflow region, said means to extract the portion of the digesting liquor being arranged to extract liquor from said intermediate region.

3. The apparatus as recited in claim 2, further comprising recirculating means to recirculate at least a portion of said digesting liquor back to said cooking zone and selectively direct a portion of the digesting liquor extracted from the digesting zone to another location for further processing.

4. The apparatus as recited in claim 3, wherein there is a second means to extract a second portion of the digesting liquor from said digesting chamber at a location downstream of said intermediate region.

5. The apparatus as recited in claim 1, wherein a. said apparatus is a continuous pulp digester with the containing structure having the inlet means at an upper end thereof, and having the outlet means at a lower end thereof, said processing chamber comprising an upper first cooking zone, and a second lower cooking zone;

b. said strainer means being located between said first cooking zone and said second cooking zone, with the means to extract a portion of the digesting liquor extracting liquor flowing downwardly from said first cooking zone;

c. said means to introduce at least a portion of relatively fresh liquid being arranged to introduce the fresh liquor as at least a portion of liquor flowing downwardly into said second cooking zone.

6. The apparatus as recited in claim 5, wherein there is circulating means to recirculate at least a portion of the digesting liquor extracted from a location between said first and second cooking zones to be introduced into an upper portion of said first cooking zone.

7. A method of digesting wood chip material comprising:

a. providing a containing structure defining a digesting chamber;

b. directing said wood chip material and a cooking liquor into said chamber said cooking liquor consisting essentially of alcohol, selected from a group consisting of ethyl alcohol, methyl alcohol and combinations thereof;

c. moving said wood chip material through said digesting chamber while cooking said wood material under heat and pressure during an initial cooking phase;

d. extracting at least a portion of digesting liquor from said processing chamber subsequent to said initial cooking phase through at least a portion of strainer means in said chamber, while retaining said wood chip material in said chamber said wood chip material being characterized in that said wood chip material, in being cooked by said liquor, forms scaling on strainer means when pH of the cooking liquor is at scale forming pH level between about 3.5 and 6.5;

e. introducing at least a portion of relatively fresh liquor into said digesting chamber to replace at least part of the cooking liquor removed so as to adjust the pH level of the cooking liquor in the chamber upwardly to a pH level sufficiently high to inhibit scaling and/or clogging of said strainer means as the wood chip material continues to pass through the digesting chamber;

f. continuing to cook said wood chip material in said digesting chamber during a second cooking phase while the pH level of the cooking liquor remains above the scale forming pH level;

g. removing said wood chip material and at least a portion of said cooking liquor from said digesting chamber.

8. The method as recited in claim 7, wherein said wood chip material and said cooking liquor is moved in a continuous manner from an inflow region of a digesting zone to an outflow region, and there is an intermediate region between the inflow region and the outflow region, said at least a portion of the digesting liquor being extracted from said intermediate region.

9. The method as recited in claim 8, further comprising recirculating at least a part of said digesting liquor that is extracted back to said digesting zone and selectively directing a portion of the digesting liquor extracted from the digesting zone to another location for further processing.

10. The method as recited in claim 9, wherein a second portion of digesting liquor is extracted from said digesting chamber through second strainer at a location downstream of said intermediate region.

* * * * *